United States Patent [19]

Sumner

[11] Patent Number: 4,597,117

[45] Date of Patent: Jul. 1, 1986

[54] ADJUSTABLE BASE SUPPORT APPARATUS FOR A WATERBED OR A SIMILAR ARTICLE

[75] Inventor: Samuel Sumner, Amsterdam, N.Y.

[73] Assignee: First Amsterdam Corp., New York, N.Y.

[21] Appl. No.: 689,298

[22] Filed: Jan. 7, 1985

[51] Int. Cl.[4] ..... A47C 19/04; A47C 19/22

[52] U.S. Cl. ..... 5/181; 5/185; 5/308

[58] Field of Search ..... 5/400, 181, 184, 185, 5/131, 451, 285, 308

[56] References Cited

U.S. PATENT DOCUMENTS

| | | | |
|---|---|---|---|
| 3,745,596 | 7/1973 | Copeland | 5/308 |
| 4,110,854 | 9/1978 | Sjolie | 5/308 |
| 4,391,008 | 7/1983 | Yomaoka | 5/308 |

*Primary Examiner*—Alexander Grosz
*Attorney, Agent, or Firm*—Arthur L. Plevy

[57] ABSTRACT

A base support apparatus includes a right and a left unit each of a rectangular, symmetrical configuration. Each unit has a front wall of a given length with extending side sections at each end. Each unit has a back wall of a shorter length with corresponding extending side sections at each end and extending towards the associated front wall. The corresponding side sections of the front and back walls are parallel and spaced apart to form slots or spaces for each unit which slots or spaces face each other. The units are separated by a desired width by means of cross tie members positioned between the back walls of the units. When assembled, the spaces provided accommodate sliding panels to close the ends of the base support units to provide a closed support base structure.

20 Claims, 5 Drawing Figures

ADJUSTABLE BASE SUPPORT APPARATUS FOR A WATERBED OR A SIMILAR ARTICLE

BACKGROUND OF THE INVENTION

This invention relates to a support base for a waterbed and more particularly to an adjustable support base enabling accommodation of waterbeds of different widths.

The prior art is replete with a great number of patents and structures which depict various base and support assemblies for waterbeds and the like.

See for example U.S. Pat. No. 4,110,854 entitled MODULAR BASE FOR WATERBED OR THE LIKE issued on Sept. 5, 1978 to R. H. Sjolie. This patent describes a modular base for a waterbed where the base is formed of a plurality of discrete segments which serve to support the bed and provide storage space. The segments are associated with a dadoed frame which holds the same in place.

See also U.S. Pat. No. 4,391,008 issued on July 5, 1983 and entitled ELEMENTS FOR ASSEMBLY OF KNOCKED-DOWN WATERBED PEDESTAL by D. N. Yomaoka et al. This patent depicts a waterbed pedestal which consists of a frame with front, back and sides, having openings for insertion of drawers. U-shaped brackets are mounted to the front and back of the frame into which a first set of dividers is inserted, additional brackets are mounted to the interior of the sides of the frame and to the first set of dividers, and a second set of dividers are inserted perpendicular to the first set; the back and the end portions of the sides of the drawers are dove-tailed to create a cavity between the side surfaces of dove-tailed slots within which an elongated sliver is fitted.

As one can ascertain from the above references and others, such prior art structures are complicated and difficult to assemble and thus present formidable problems for the consumer and manufacturer. Apart from these problems is the fact that beds, including waterbeds, come in various widths as queen, king, double and twin. Hence prior art base supports did not easily accommodate the various width beds requiring extensive structural repairs to be made or requiring a distributor or a manufacturer to carry different width supports to accommodate the different bed sizes.

It is, therefore, an object of the present invention to provide an improved base support for a waterbed or a similar article which support is easily adjustable and further which has the utility of providing the consumer with additional storage room in the form of drawer assemblies.

BRIEF DESCRIPTION OF THE PREFERRED EMBODIMENT

A base support apparatus for a waterbed or similar article comprising right and left units each of a rectangular configuration having a front wall and a back wall with said back wall having coupling means spaced along the top surface thereof, and said back wall having extending front and rear side sections which extend towards said front wall, said front wall having corresponding extending front and rear side sections which extend towards said back wall with said extending front and rear side sections of said front and back walls forming a space therebetween and means for coupling the corresponding extending sections of said front wall to a corresponding extending section of said back wall to form a defined space with the spaces of said right unit facing the spaces of said left unit at both said front and rear ends, with said left and right units coupled together by cross tie means directed between said back walls and coacting with said spaced coupling means to vary the distance between said left and right units according to the length of said cross ties, and first and second slideable panels inserted in said spaces at said front and rear ends to close said ends independent of the length of said cross ties means.

DETAILED DESCRIPTION OF THE FIGURES

Figure 1:
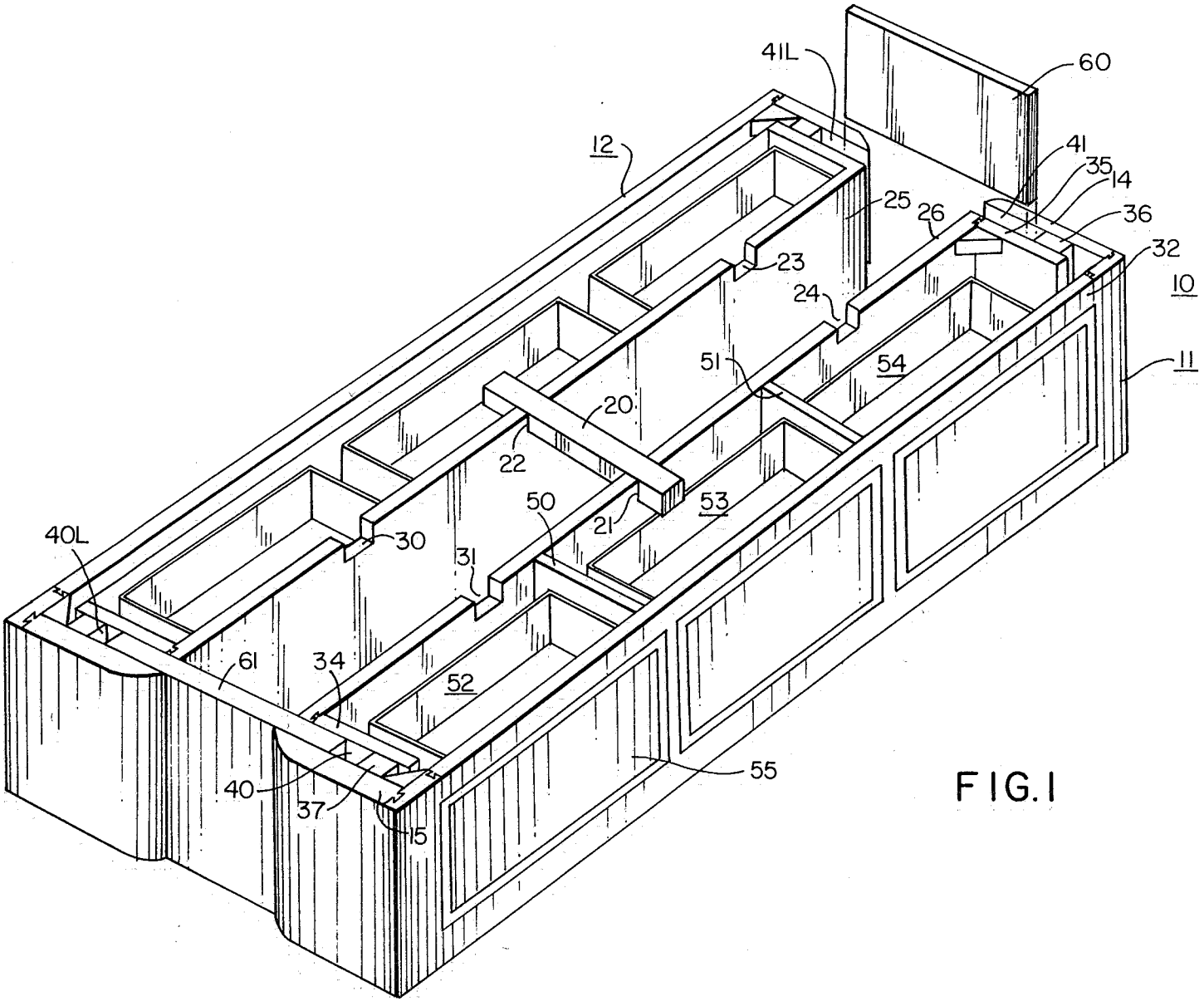
FIG. 1 is a perspective plan view of a base support according to this invention.

Referring to FIG. 1, there is shown a perspective plan view of a base support apparatus 10 according this invention.

The base support apparatus typically serves to support a waterbed but can be employed for the support of a mattress and box spring or can be used as a support for other types of furniture.

The base support 10 consists of a symmetrical right rectangular section or unit 11 and a left rectangular section or unit 12. The sections are coupled together by means of cross tie members as 20, which member has right and left rectangular cutouts or slots 21 and 22 for coacting with corresponding cutouts or slots as 23 and 24 in the back wall surfaces 25 and 26 of sections 11 and 12.

The tie or cross members 20 are prefabricated to one standard length to fit all sizes or can be precut for different lengths.

Thus as depicted in FIG. 1, the back wall surfaces of the sections 11 and 12 have corresponding slots or cutouts as 23 and 24, 30 and 31 to accommodate the different length tie members as 20 to adjust the width of the entire support 10.

Each section as 11 and 12 is basically identical in configuration and consists of a front wall 32 which is coupled by means of a dove-tail or some other joint to a front and a back side section 14 and 15. The side sections 14 and 15 are secured to interior side sections 34 and 35 associated with the back wall 26 by means of support coupling members as 36 and 37, to thus form a space 40 between the inner wall of section 15 and the outer wall of section 34 and a space 41 between the inner wall of section 14 and the outer wall of section 35.

The side sections 34 and 35 are coupled or secured to the slotted back wall surfaces 25 and 26 by conventional dove-tailed joints or any other joining means as screws, glue and so on. Each section has a series of partitioning panels as 50 and 51 to form compartments into which drawer structures as 52, 53 and 54 are inserted. The front surface 55 of the drawer 52 extends through a drawer accommodating aperture in the front panel as panel 32. A knob or handle may be employed as well to allow for easy opening and closing of the drawer 52.

As can be seen from FIG. 1, when a consumer purchases the support base 10, he will receive cross or tie members 20 to accommodate the proper width of his bed. These members are positioned with their slots 21 and 22 in the slots as 23 and 24 of the back wall surfaces. Slideable panels as 60 and 61 are then inserted into the spaces as 40 and 41 described above to complete the assembly and to give the entire unit a pleasing and uniform appearance and thus to close the front and back sides.

Thus the panels 60 and 61 as well as the tie members 20 are pre-cut to accommodate all anticipated widths to be implemented by the length of the cross tie members as 20. The members 60 and 61 as well as members 20 can be of a standard length or precut to any length to restrict the opening or closing between sections 11 and 12 as shown. The consumer can easily implement the assembly with no tools or structure changes required.

It is, of course, understood that while the sections 11 and 12 are shown to contain drawers for storage purposes, these can be eliminated if desired. The concept being that the tie members 20 together with the slideable panels 60 and 61 which are inserted into the spaces or slots 40 and 41 formed by the structure enable width adjustment of the base 10 with a minimum of effort. As indicated, the sections 11 and 12 are completely symmetrical. This results in substantial savings in manufacturing as well as in storage room.

Thus as seen in FIG. 1, each section or unit 11 and 12 consists of a front wall as 32 having extending from the end side sections or panels 14 and 15. The backwalls as 26 are slotted and have extending side sections 34 and 35, with the back wall 26 being shorter than the front wall 32. The side sections as 15 and 34 are parallel to each other to form the spaces 40 to accommodate the sliding panel 61. The walls as 15 and 34 are coupled together by means of a support member as 37. Hence the space or slot 40 of the right unit 11 faces the space 40L of the left unit 12 at one end. At the other end, the space 41 of the right unit 11 faces the space 41L of the left unit 12. The units 11 and 12 are spaced apart by the required width by the cross tie members 20 which are inserted into the slots as 23, 24, 30 and 31. The panels 60 and 61 close the opened ends of the unit 10, then assembled as shown with the cross ties 20 in position.

Figure 2:
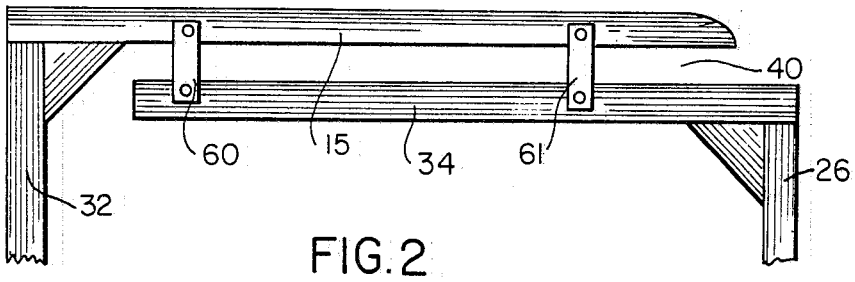
FIG. 2 is a partial top plan view of one coupling structure for forming the support of FIG. 1.

Referring to FIG. 2, there is shown a top plan sectional view depicting a front section as 15 of FIG. 1 coupled to an inner side section 34 of FIG. 1 to form the space 40 for accommodating the slideable panel 61. The same reference numerals are used for clarity. In FIG. 2, the sections 15 and 34 are coupled together by means of top and bottom metal brackets as 60 and 61 which replace the columns as 36 and 37 of FIG. 1.

Figure 3:
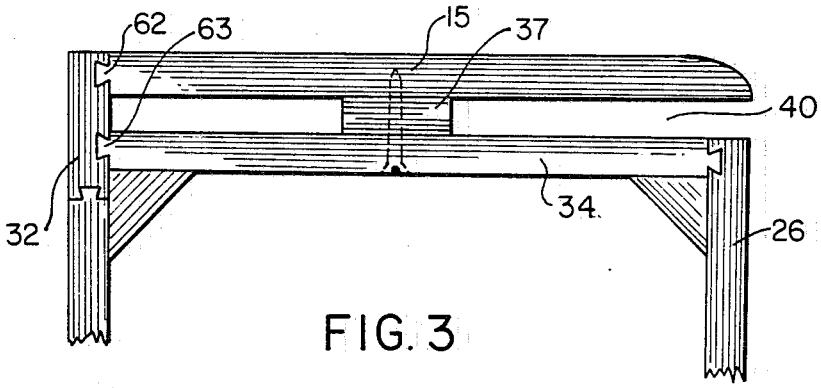
FIG. 3 is a partial top plan view of an alternate coupling structure.

In FIG. 3, there is shown an alternate coupling scheme. Here section 15 as well as section 34 are coupled to the front surface 32 of a section as 11 by means of dove-tailed joints 62 and 63. A block as 37 of FIG. 1 is screwed in place to form the space 40.

Figure 4:
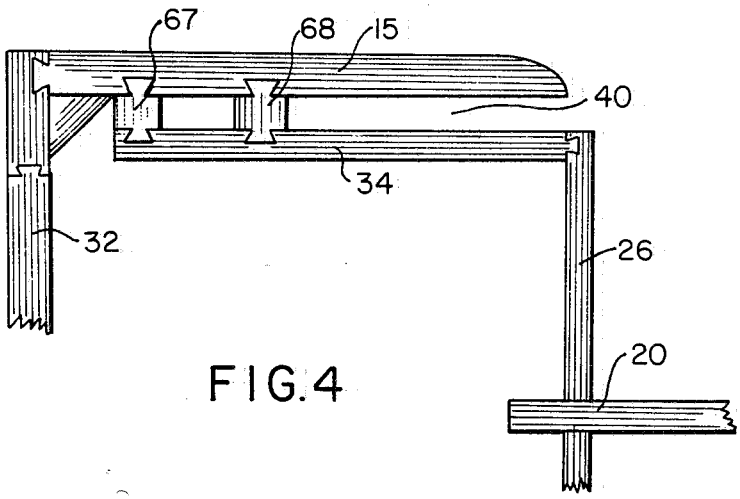
FIG. 4 is a partial top plan view of still another coupling structure.

In FIG. 4, there is shown still another coupling scheme to form the space or slot 40. The structure of FIG. 4 uses dove-tail coupling blocks 67 and 68 to join sections 15 and 34. A cross bar as 20 of FIG. 1 is shown in section positioned in a slot associated with the back sidewall 26.

Figure 5:
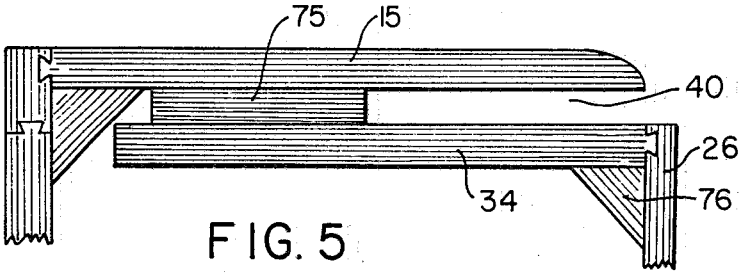
FIG. 5 is a partial top plan view of still another alternate coupling structure.

In FIG. 5, the sections 15 and 34 are coupled by a larger vertical member 75 which may be glued or otherwise secured therebetween to form the space 40. Typical right angled supports as 76 for strengthening the corners are conventionally employed.

As one can ascertain, the above base support 10 is adjustable in width and is an extremely strong and reliable structure. It consists of right and left symmetrical rectangular sections 11 and 12 which as fabricated include front and back spaces as 40 and 41 to hold slideable panels as 60 and 61 for any necessary width mattress or waterbed.

The base support 10 presents an extremely aesthetic appearance and is easy to manufacture and use.

It is apparent that other modifications and alterations will be discernable by those skilled in the art and are deemed to be within the spirit and scope of the claims as appended hereto.

I claim:

1. A base support apparatus for a waterbed or similar article comprising:

right and left units each of a rectangular configuration having a front wall and a back wall with said back wall having coupling means spaced along the top surface thereof, and said back wall having extending front and rear side sections which extend towards said front wall, said front wall having corresponding extending front and rear side sections which extend towards said back wall with said extending front and rear side sections of said front and back walls forming a space therebetween and means for coupling the corresponding extending sections of said front wall to a corresponding extending section of said back wall to form a defined space with the spaces of said right unit facing the spaces of said left unit at both said front and rear ends, with said left and right units coupled together by cross tie means directed between said back walls and coacting with said spaced coupling means to vary the distance between said left and right units according to the length of said cross ties, and first and second slideable panels inserted in said spaces at said front and rear ends to close said ends independent of the length of said cross tie means.

2. The base support apparatus according to claim 1, wherein at least one of said left and right units include at least one drawer positioned in an aperture in said front wall and directed towards said back wall for providing storage.

3. The base support apparatus according to claim 1, wherein said coupling means spaced along the top surface of said back wall comprises a plurality of spaced slots along said top surface and adapted to accommodate said cross tie means.

4. The base support apparatus according to claim 3, wherein said cross tie means is a rectangular member having a first slot at a right end and a second slot at a left end for insertion into a corresponding slot in the back wall of said right and left units to couple said units together at a distance determined by the length of said rectangular member.

5. The base support apparatus according to claim 1, wherein said means for coupling one of said corresponding extending side sections to said other comprises a bracket extending between said sections to secure said sections together according to the space therebetween.

6. The base support apparatus according to claim 1, wherein said means for coupling one of said corresponding extending sections to said other comprises a vertical support member positioned between said sections coupled to each section at a corresponding surface by section coupling means.

7. The base support apparatus according to claim 6, wherein said section coupling means includes a screw directed through one section, through said vertical support member and into said other section.

8. The base support apparatus according to claim 6, wherein said section coupling means is a glue bond.

9. The base support apparatus according to claim 6, wherein said vertical support member includes first and second dove-tailed assemblies for coacting with dove-tailed apertures on said corresponding side sections.

10. A base support apparatus for a waterbed or similar article, said base support apparatus capable of being adjusted according to the width of an article to be accommodated, comprising:

right and left symmetrical rectangular units, each including a front wall of a given length and having extending from the ends front and back side sections, with the front and back side sections of said right and left units facing each other, each unit further including a back wall, with each back wall of a shorter length than the front wall and having corresponding front and back side sections extending from the ends with the sections extending towards the associated front wall and directed parallel to and spaced from the extending side section of said associated front wall and means securing said associated parallel sections to each other at each end to form a space at each end with the spaces of said right unit facing the spaces of said left unit, with each of the back walls of said right and left units having slots along the top surface, with cross tie members of a given selected lengths positioned within said slots to separate said right and left units according to the width of said article to be accommodated, with slideable panels inserted within said spaces at each end of said units to effectively close said end surfaces when said right and left units are coupled together by said cross tie members.

11. The base support apparatus according to claim 10, wherein said cross tie members is of a rectangular configuration with a slot at each end for insertion into a corresponding slot in the back wall of said right and left units.

12. The base support apparatus according to claim 10, wherein at least one of said right and left units contain a drawer member inserted into a corresponding aperture in the front wall of said associated unit for storage purposes.

13. The base support apparatus according to claim 10, wherein the length of said cross tie members is selected according to the width of a queen size mattress.

14. The base support apparatus according to claim 10, wherein the length of said cross tie members is selected according to the width of a king sized mattress.

15. The base support apparatus according to claim 10, wherein the means for securing said associated parallel sections comprise a vertical rectangular support member secured at corresponding surfaces to said associated side sections.

16. The base support apparatus according to claim 15, wherein said support member is secured by means of screws.

17. The base support apparatus according to claim 15, wherein said support member is secured by means of a glue bond.

18. The base support apparatus according to claim 15, wherein said support member is secured by means of dove-tailed joints.

19. The base support apparatus according to claim 10, wherein said means for securing said associated parallel sections includes at least a top and a bottom bracket.

20. The base support apparatus according to claim 10, wherein each of said extending side sections as extending from said front and back walls is supported to said associated wall by a right angled support member.

* * * * *